US010837265B2

(12) United States Patent
Kohn et al.

(10) Patent No.: US 10,837,265 B2
(45) Date of Patent: Nov. 17, 2020

(54) COLLAPSIBLE CONE FOR AN EXPANDABLE LINER HANGER SYSTEM

(71) Applicant: Halliburton Energy Services, Inc., Houston, TX (US)

(72) Inventors: Gary Allen Kohn, Carrollton, TX (US); Carlos Alberto Moreno, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 170 days.

(21) Appl. No.: 16/072,601

(22) PCT Filed: Feb. 29, 2016

(86) PCT No.: PCT/US2016/020042

§ 371 (c)(1),
(2) Date: Jul. 25, 2018

(87) PCT Pub. No.: WO2017/151092

PCT Pub. Date: Sep. 8, 2017

(65) Prior Publication Data

US 2019/0040721 A1 Feb. 7, 2019

(51) Int. Cl.
*E21B 43/10* (2006.01)
*E21B 29/10* (2006.01)

(52) U.S. Cl.
CPC ..... *E21B 43/105* (2013.01); *E21B 29/10* (2013.01)

(58) Field of Classification Search
CPC ..... E21B 43/103; E21B 43/105; E21B 43/108
See application file for complete search history.

(56) References Cited

U.S. PATENT DOCUMENTS 6,739,398 B1 5/2004 Yokley et al.
2007/0012443 A1 1/2007 Luke et al.
(Continued)

FOREIGN PATENT DOCUMENTS

CN 202417367 U 9/2012
CN 204113166 U 1/2015
(Continued)

OTHER PUBLICATIONS

International Search Report and the Written Opinion of the International Search Authority, or the Declaration, dated Nov. 22, 2016, PCT/US2016/020042, 17 pages, ISA/KR.
(Continued)

*Primary Examiner* — Giovanna Wright
(74) *Attorney, Agent, or Firm* — Haynes and Boone, LLP

(57) ABSTRACT

An expandable liner hanger system and method of installing same. In an exemplary embodiment, the method includes positioning the expandable liner hanger system within a casing string, the expandable liner hanger system including a setting tool disposed within a hanger body, the setting tool including a cone mandrel defining a tapered external surface and an expansion cone defining a tapered internal surface; engaging the tapered external surface with the tapered internal surface; radially expanding the hanger body to engage the casing string by displacing the cone mandrel and the expansion cone in a first axial direction and relative to the hanger body; displacing the cone mandrel in a second axial direction and relative to the expansion cone to disengage the tapered internal surface from the tapered external surface, thus permitting the expansion cone to bell radially inward from the hanger body; and extricating the expansion cone from the hanger body.

20 Claims, 10 Drawing Sheets

(56) References Cited

U.S. PATENT DOCUMENTS

| | | | |
|---|---|---|---|
| 2010/0252252 | A1 | 10/2010 | Harris et al. |
| 2011/0079383 | A1 | 4/2011 | Porter et al. |
| 2012/0037381 | A1 | 2/2012 | Giroux et al. |
| 2012/0222868 | A1 | 9/2012 | Hazelip |
| 2013/0299197 | A1 | 11/2013 | Bennett |

FOREIGN PATENT DOCUMENTS

| | | | |
|---|---|---|---|
| GB | 2346165 | A | 8/2000 |
| WO | WO 2007/017355 | A1 | 2/2007 |
| WO | WO 2010/114592 | A2 | 10/2010 |

OTHER PUBLICATIONS

Extended European Search Report issued by the European Patent Office for Application No. EP 16892843, dated Sep. 20, 2019, 7 pages.

Written Opinion issued by the Intellectual Property Office of Singapore for Application No. 11201806165Q, dated Sep. 26, 2019, 6 pages.

Chinese Office Action issued for Application No. 201680077510.6, dated Dec. 4, 2019, and its English translation; 23 pages.

Indian Examination Report issued for Application No. 201817026231, dated Dec. 6, 2019, 6 pages.

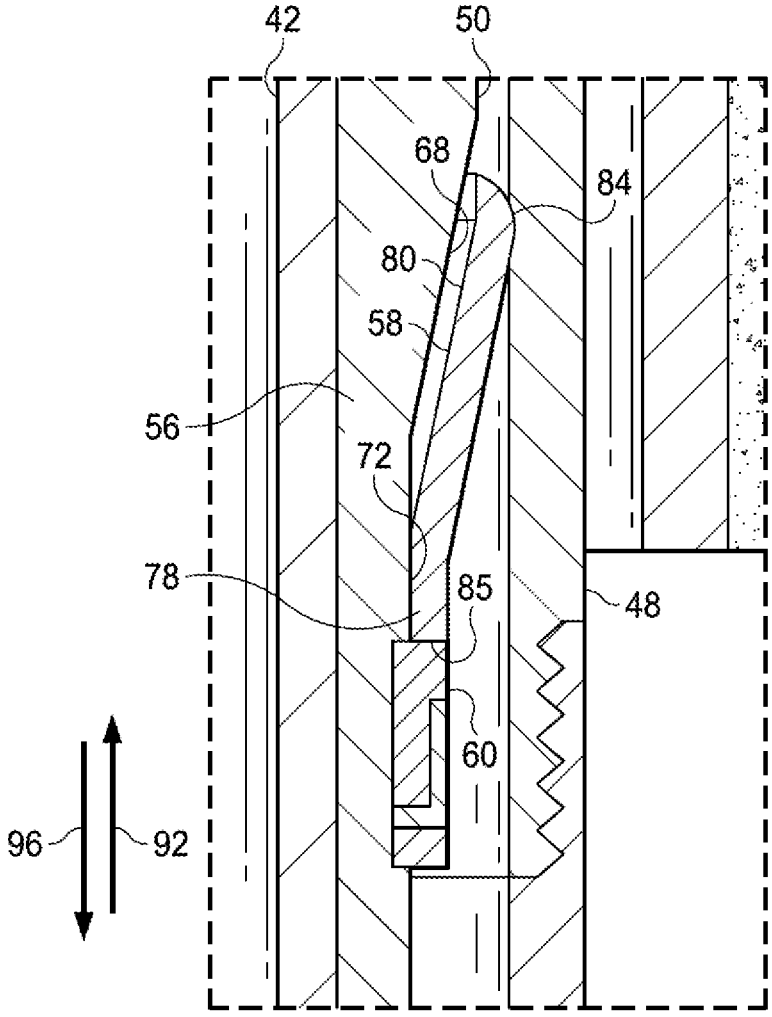
Fig. 6D(ii)

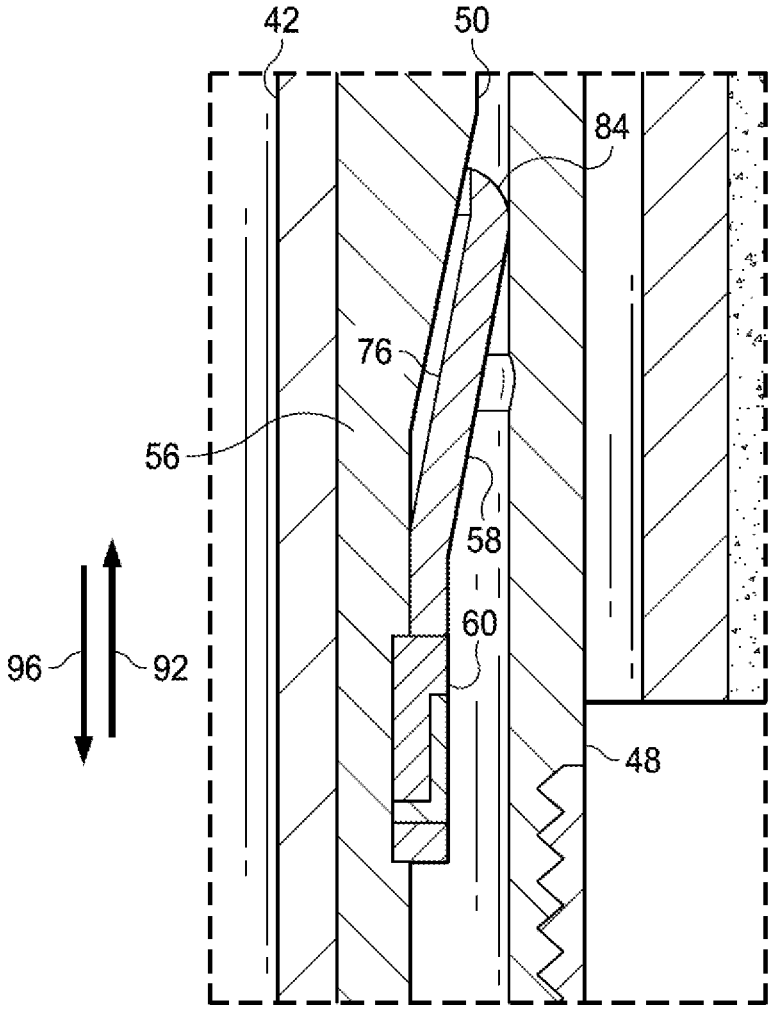
Fig. 6D(iii)

COLLAPSIBLE CONE FOR AN EXPANDABLE LINER HANGER SYSTEM

PRIORITY

The present application is a U.S. National Stage patent application of International Patent Application No. PCT/US2016/020042, filed on Feb. 29, 2016, the benefit of which is claimed and the disclosure of which is incorporated herein by reference in its entirety.

TECHNICAL FIELD

The present disclosure relates generally to expandable liner hanger systems, and, more specifically, to a setting tool including a collapsible cone for an expandable liner hanger system.

BACKGROUND

Expandable liner hanger systems operate, for example, by utilizing a setting tool to promote the expansion of a liner hanger, thus connecting the liner hanger to a casing string disposed within a wellbore. In order to effectuate the expansion of the liner hanger, an expansion cone is displaced axially through the liner hanger, thus engaging the interior of the liner hanger to radially expand the exterior thereof. The forces required to expand a liner hanger in this manner, which can be considerable, are a function of the geometry, material properties, and friction reducing coatings applied to the expansion cone and/or the liner hanger.

Certain differences in hardness and/or other basic metallurgical properties between the liner hanger and the expansion cone can help to mitigate galling between the respective contacting surfaces thereof, even if the friction reducing coating(s) becomes compromised. Accordingly, conventional liner hangers are manufactured with highly ductile low alloy steel, the expansion of which can be effectuated using an expansion cone manufactured with, for example, D2 tool steel. However, some liner hangers incorporate nickel and chromium-based alloys to provide corrosion resistance within the wellbore. Conventional expansion cones do not have the proper material properties to effectively expand such nickel and chromium-based liner hangers. Further, the use of more effective materials is often prohibitively expensive because of the geometry of conventional expansion cones.

Moreover, conventional expansion cones are often difficult or impossible to remove from the liner hanger once the liner hanger has been expanded. Although collapsible expansion cones exist to address this issue, such collapsible expansion cones often incorporate a collet feature that permits the expansion cone to bend radially inward from the interior of the liner hanger. However, the machined slits of the collet feature create high contact stresses along the respective edges of the slits, which stresses can cause damage to, among other things, the friction reducing coating (s) applied to the liner hanger and/or the expansion cone.

Furthermore, some expansion cones require a sealing interface between the expansion cone and the interior of the liner hanger so that the expansion cone may be actuated by a fluid pressure. The machined slits associated with conventional collapsible expansion cones necessitate the use of a "lead cone" that has no slits, surface features, or other geometry that could create a leak path. Such a "lead cone" necessarily has a smaller diameter than the collapsible expansion cone, thereby reducing the effective axial force imparted to the setting tool by the fluid pressure.

Therefore, what is needed is an apparatus, method, or system that addresses one or more of the foregoing issues, among others.

BRIEF DESCRIPTION OF THE DRAWINGS

Various embodiments of the present disclosure will be understood more fully from the detailed description given below and from the accompanying drawings of various embodiments of the disclosure. In the drawings, like reference numerals may indicate identical or functionally similar elements.

FIG. 6D(ii) depicts the expandable liner hanger system of FIG. 6D(i), with the hanger body expanded and the setting tool in a second configuration, according to an exemplary embodiment.

FIG. 6D(iii) depicts the expandable liner hanger system of FIGS. 6D(i) and (ii), with the hanger body expanded and the setting tool in a third configuration, according to an exemplary embodiment.

DETAILED DESCRIPTION

Figure 1:
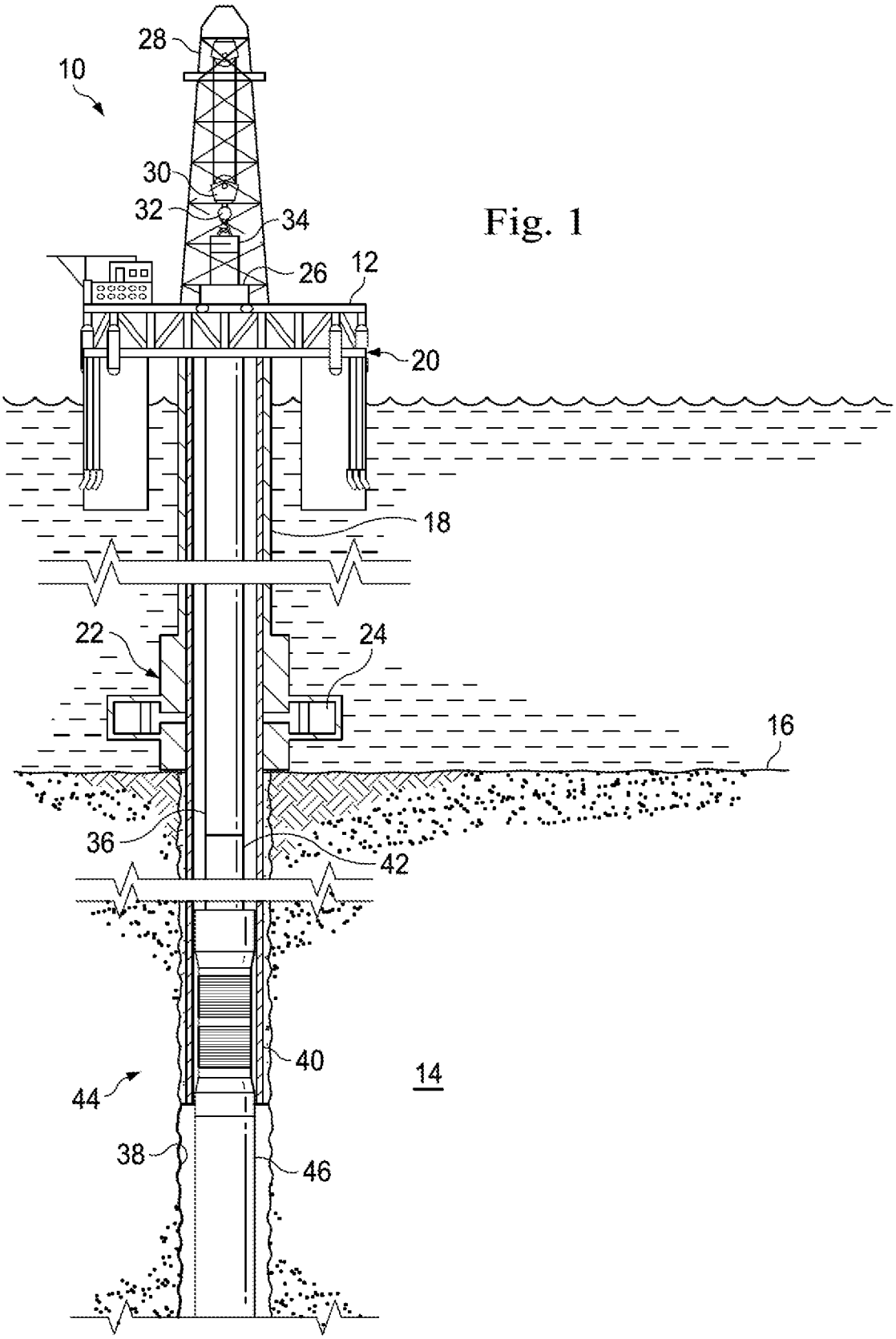
FIG. 1 is a schematic illustration of an offshore oil and gas platform operably coupled to an expandable liner hanger system, according to an exemplary embodiment.

This disclosure may repeat reference numerals and/or letters in the various examples or Figures. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the Figures. For example, if an apparatus in the Figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover, even though a Figure may depict a horizontal wellbore or a vertical wellbore, unless indicated otherwise, it should be understood by those skilled in the art that the apparatus according to the present disclosure is equally well suited for use in wellbores having other orientations including vertical wellbores, horizontal wellbores, slanted wellbores, multilateral wellbores or the like. Likewise, unless otherwise noted, even though a Figure may depict an offshore operation, it should be understood by those skilled in the art that the apparatus according to the present disclosure is equally well suited for use in onshore operations. Further, unless otherwise noted, even though a Figure may depict a cased-hole wellbore, it should be understood by those skilled in the art that the apparatus according to the present disclosure is equally well suited for use in open-hole wellbore operations.

Referring to FIG. 1, an offshore oil and gas platform is schematically illustrated and generally designated by the reference numeral 10. In an exemplary embodiment, the offshore oil and gas platform 10 includes a semi-submersible platform 12 that is positioned over a submerged oil and gas formation 14 located below a sea floor 16. A subsea conduit 18 extends from a deck 20 of the platform 12 to a subsea wellhead installation 22. One or more pressure control devices 24, such as, for example, blowout preventers (BOPs), and/or other equipment associated with drilling or producing a wellbore may be provided at the subsea wellhead installation 22 or elsewhere in the system. The platform 12 may include a hoisting apparatus 26, a derrick 28, a travel block 30, a hook 32, and a swivel 34, which components are together operable for raising and lowering a variety of conveyance vehicles 36, such as, for example, casing, drill pipe, coiled tubing, production tubing, other types of pipe or tubing strings, and/or other types of conveyance vehicles, such as wireline, slickline, and the like. In the embodiment of FIG. 1, the conveyance vehicle 36 is a substantially tubular, axially extending drill string made up of a plurality of drill pipe joints coupled together end-to-end. The platform 12 may also include a kelly, a rotary table, a top drive unit, and/or other equipment associated with the rotation and/or translation of the conveyance vehicle 36. A wellbore 38 extends from the subsea wellhead installation 22 and through the various earth strata, including the formation 14. A portion of the wellbore 38 includes a casing string 40 cemented therein.

As shown in FIG. 1, a section of the wellbore 38 has been formed below the casing string 40 through the use of, for example, a bottom-hole assembly (not shown). The bottom-hole assembly is adapted to be connected at the lower end portion of the conveyance vehicle 36 and to extend within the wellbore 38 during drilling operations. The bottom-hole assembly includes, for example, a rotary drill bit adapted to bore through the various earth strata, including the formation 14. The bottom-hole assembly may also include other components such as, for example, a directional drilling tool, a mud motor, a telemetry system, a power generation system, logging-while-drilling tools, measurement-while-drilling tools, drill collars, heavy-weight drill pipe, stabilizers, reamers, jarring devices, hole-openers, crossovers for various threadforms, other downhole components, or any combination thereof. Once the bottom-hole assembly has been utilized to form a section of the wellbore 38, the bottom-hole assembly is removed from the wellbore 38, via the conveyance vehicle 36. Accordingly, FIG. 1 illustrates the wellbore 38 after the bottom-hole assembly has been removed.

Still referring to FIG. 1, a running tool 42 is connected at the lower end portion of the conveyance vehicle 36. The running tool 42 and the conveyance vehicle 36 are utilized to lower an expandable liner hanger system 44, to which a liner string 46 is connected, into the wellbore 38. More particularly, once the expandable liner hanger system 44 is coupled to the running tool 42, the conveyance vehicle 36 is used to position the running tool 42 and, consequently, the expandable liner hanger system 44, at the lower end portion of the casing string 40, as shown in FIG. 1. As a result, the liner string 46 extends downhole from the expandable liner hanger system 44 and into the "open-hole" section of the wellbore 38, below the casing string 40. When the liner string 46 and the expandable liner hanger system 44 are positioned as such, the expandable liner hanger system 44 is adapted to be expanded to engage the interior of the casing string 40, thus securing the expandable liner hanger system 44 and, consequently, the liner string 46, to the casing string 40. In this manner, the expandable liner hanger system 44 is utilized to extend the "cased-hole" portion of the wellbore 38, as will be discussed in further detail below.

Figure 2:
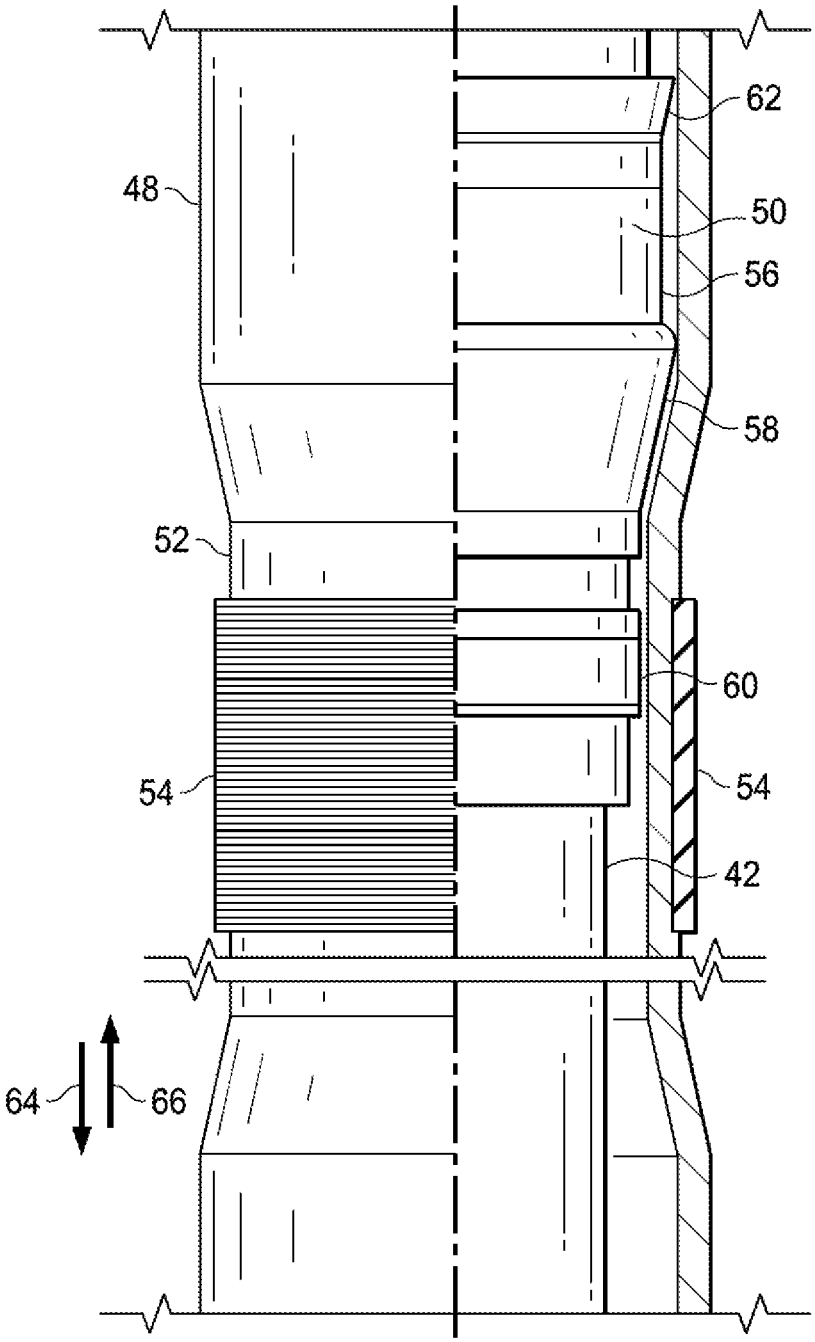
FIG. 2 is a partial-sectional view of the expandable liner hanger system of FIG. 1, including a setting tool and a hanger body, according to an exemplary embodiment.

Referring to FIG. 2, an exemplary embodiment of the expandable liner hanger system 44 is shown, which embodiment includes a hanger body 48 and a setting tool 50 that extends within the hanger body 48. The hanger body 48, in turn, is adapted to extend within the casing string 40 (as shown in FIG. 1).

In an exemplary embodiment, as shown in FIG. 2, the hanger body 48 includes a reduced diameter portion 52 having one or more contact elements 54 connected to the exterior thereof. When the hanger body 48 extends within the casing string 40, the reduced diameter portion 52 thereof is adapted to be expanded into engagement with the interior of the casing string 40. Moreover, the contact elements 54 are adapted to form a frictional interface with the interior of the casing string 40 when the reduced diameter portion 52 is expanded, thus connecting the hanger body 48 to the casing string 40. In several exemplary embodiments, the contact elements 54 are, include, or are part of a cylindrical seal made of a rubber material and adapted to form a frictional interface with the interior of the casing string 40 when the reduced diameter portion 52 is expanded. In several exemplary embodiments, the contact elements 54 are, include, or are part of a plurality of casing slips adapted to engage, or "bite" into, the interior of the casing string 40 when the reduced diameter portion 52 is expanded. In several exemplary embodiments, the contact elements 54 are integrally formed with the hanger body 48 and are designed to sealingly engage the interior of the casing string 40 when the hanger body 48 is expanded. In some embodiments, in order to provide corrosion resistance within the wellbore, the hanger body 48 is manufactured from a nickel-based alloy, such as, for example, Incoloy® Alloy 825 and/or Inconel® Alloy G3, among others. In some embodiments, in order to provide corrosion resistance within the wellbore, the hanger body 48 is manufactured from a chromium-based alloy, such as, for example, super 13 chromium alloy, among others.

In an exemplary embodiment, with continuing reference to FIG. 2, the setting tool 50 is connected to the running tool 42 and extends within the hanger body 48. The setting tool 50 includes a cone mandrel 56, a collapsible expansion cone 58, and a cone retainer 60. In several exemplary embodiments, the setting tool 50 also includes a wiper 62 adapted to prevent debris from settling on top of the collapsible expansion cone 58. The cone mandrel 56 has a generally annular shape and is connected to, and extends about, the running tool 42. Moreover, the cone mandrel 56 extends radially between the running tool 42 and the hanger body 48. In several exemplary embodiments, the interior of the cone mandrel 56 is adapted to be engaged by the running tool 42.

The collapsible expansion cone 58 extends circumferentially about the cone mandrel 56 and is adapted to be engaged by the cone mandrel 56 when the cone mandrel 56 is displaced in an axial direction 64. As a result, the cone mandrel 56 is adapted to urge the collapsible expansion cone 58 in the axial direction 64 so that the collapsible expansion cone 58 engages the reduced diameter portion 52 of the hanger body 48. The collapsible expansion cone 58 is thus adapted to be displaced relative to the hanger body 48 to engage, and radially expand, the reduced diameter portion 52 of the hanger body 48, as will be discussed in further detail below.

The cone retainer 60 extends circumferentially about, and is connected to, the cone mandrel 56. Once the reduced diameter portion 52 of the hanger body 48 has been radially expanded by the collapsible expansion cone 58, the cone mandrel 56 is adapted to be displaced in an axial direction 66, which is opposite the axial direction 64, and relative to the collapsible expansion cone 58. As a result, the cone mandrel 56 is adapted to slide axially in relation to the collapsible expansion cone 58. Moreover, the cone retainer 60 is adapted to engage the collapsible expansion cone 58, thereby urging the collapsible expansion cone 58 in the axial direction 66 and relative to the hanger body 48.

Figure 3:
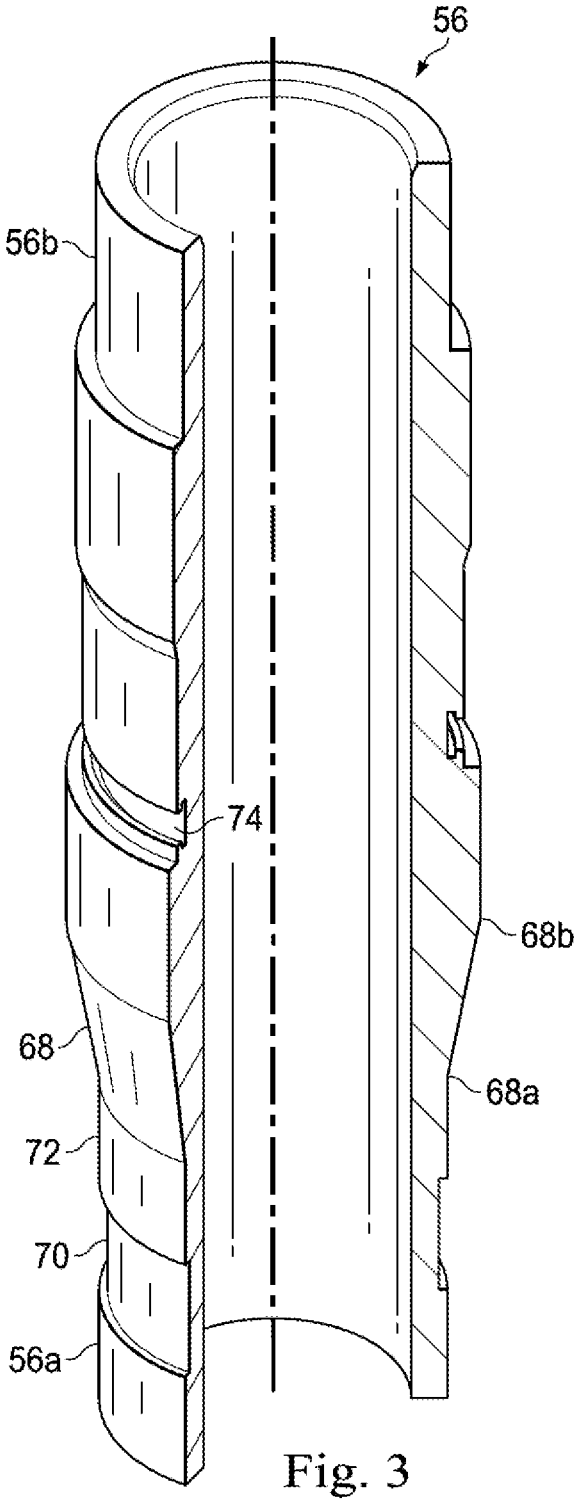
FIG. 3 is a partial-sectional view of a cone mandrel, which is a component of the setting tool of FIG. 2, according to an exemplary embodiment.

Referring now to FIG. 3, an exemplary embodiment of the cone mandrel 56 is shown. The cone mandrel 56 defines opposing end portions 56*a* and 56*b*. A tapered annular surface 68 is formed in the exterior of the cone mandrel 56. The tapered annular surface 68 defines opposing end portions 68*a* and 68*b*, the end portion 68*a* having a relatively smaller diameter than the end portion 68*b*. As a result, the wall thickness of the cone mandrel 56 is relatively smaller at the end portion 68*a* of the tapered annular surface 68 and relatively larger at the end portion 68*b* thereof. In several exemplary embodiments, the maximum wall thickness of the cone mandrel 56 is located at the end portion 68*b* of the tapered annular surface 68. Further, an external annular groove 70 is formed in the exterior of the cone mandrel 56, proximate the end portion 56*a* thereof. The external annular groove 70 is adapted to accommodate the cone retainer 60. Further still, a generally cylindrical annular contact surface 72 is formed in the exterior of the cone mandrel 56, and extends axially between the tapered annular surface 68 and the external annular groove 70. The annular contact surface 72 is adapted to be slidably engaged by the collapsible expansion cone 58 when the cone mandrel 56 is displaced in the axial direction 66 (as shown in FIG. 2) and relative to the collapsible expansion cone 58. In several exemplary embodiments, the cone mandrel 56 also includes an external annular groove 74 adapted to accommodate and retain the wiper 62 to prevent debris from settling on top of the collapsible expansion cone 58.

Figure 4:
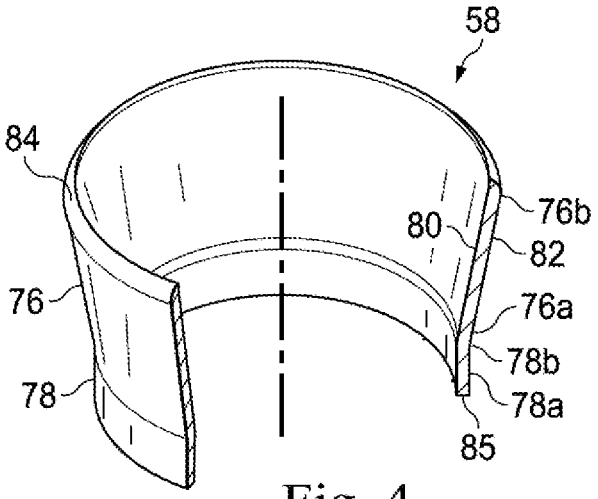
FIG. 4 is a partial-sectional view of a collapsible expansion cone, which is another component of the setting tool of FIG. 2, according to an exemplary embodiment.

Referring additionally to FIG. 4, an exemplary embodiment of the collapsible expansion cone 58 is shown, which embodiment includes a frusto-conical member 76 and a contact ring 78 connected to one another. In some embodiments, the collapsible expansion cone 58 is manufactured from 8620 alloy steel. In several exemplary embodiments, at least a portion of the collapsible expansion cone 58 is case hardened. In several exemplary embodiments, at least a portion of the collapsible expansion cone 58 is heat treated. In several exemplary embodiments, the collapsible expansion cone 58 has a nominal wall thickness of 0.035", providing a ductile interior and core beneath the heat treated and/or case hardened exterior of the collapsible expansion cone 58.

In an exemplary embodiment, as shown in FIG. 4, the frusto-conical member 76 has a generally annular shape and defines opposing end portions 76*a* and 76*b*. A tapered internal annular surface 80 is formed in the interior of the frusto-conical member 76 and extends between the respective end portions 76*a* and 76*b* thereof. The tapered internal annular surface 80 has a relatively smaller diameter at the end portion 76*a* of the frusto-conical member 76 as compared to the end portion 76*b* thereof. As a result, the tapered internal annular surface 80 is adapted to be complementarily engaged by the tapered annular surface 68 of the cone mandrel 56. A tapered external annular surface 82 is formed in the exterior of the frusto-conical member 76 and extends between the respective end portions 76*a* and 76*b* thereof. The tapered external annular surface 82 has a relatively smaller diameter at the end portion 76*a* of the frusto-conical member 76 as compared to the end portion 76*b* thereof. Further, the end portion 76*a* of the frusto-conical member 76 is connected to the contact ring 78. Thus, at the end portion 76*a* of the frusto-conical member 76, the tapered external annular surface 82 adjoins the exterior of the contact ring 78. A cone crest 84 is formed in the exterior of the frusto-conical member 76 at the end portion 76*b* thereof, adjacent the tapered external annular surface 82. The tapered external annular surface 82 and the cone crest 84 are each adapted to slidably engage the interior of the reduced diameter portion 52 of the hanger body 48. In several exemplary embodiments, the frusto-conical member 76 is, includes, or is part of the contact ring 78. In several exemplary embodiments, the frusto-conical member 76 is integrally formed with the contact ring 78.

In an exemplary embodiment, with continuing reference to FIG. 4, the contact ring 78 has a generally annular shape and defines opposing end portions 78*a* and 78*b*. The interior of the contact ring 78 is adapted to slidably engage the annular contact surface 72 of the cone mandrel 56 when the cone mandrel is displaced relative to the collapsible expansion cone 58. The contact ring 78 includes an end face 85 at the end portion 78*a* thereof. The end face 85 is adapted to be engaged by the cone retainer 60 during operation of the setting tool 50. Further, the end portion 78*b* of the contact ring 78 is connected to the end portion 76*a* of the frusto-conical member 76. Thus, at the end portion 78*b* of the contact ring 78, the exterior of the contact ring 78 adjoins the tapered external annular surface 82 of the frusto-conical member 76. In several exemplary embodiments, the contact ring 78 is generally cylindrical in shape. In several exemplary embodiments, the contact ring 78 is, includes, or is part of the frusto-conical member 76. In several exemplary embodiments, the contact ring 78 is integrally formed with the frusto-conical member 76.

Figure 5:
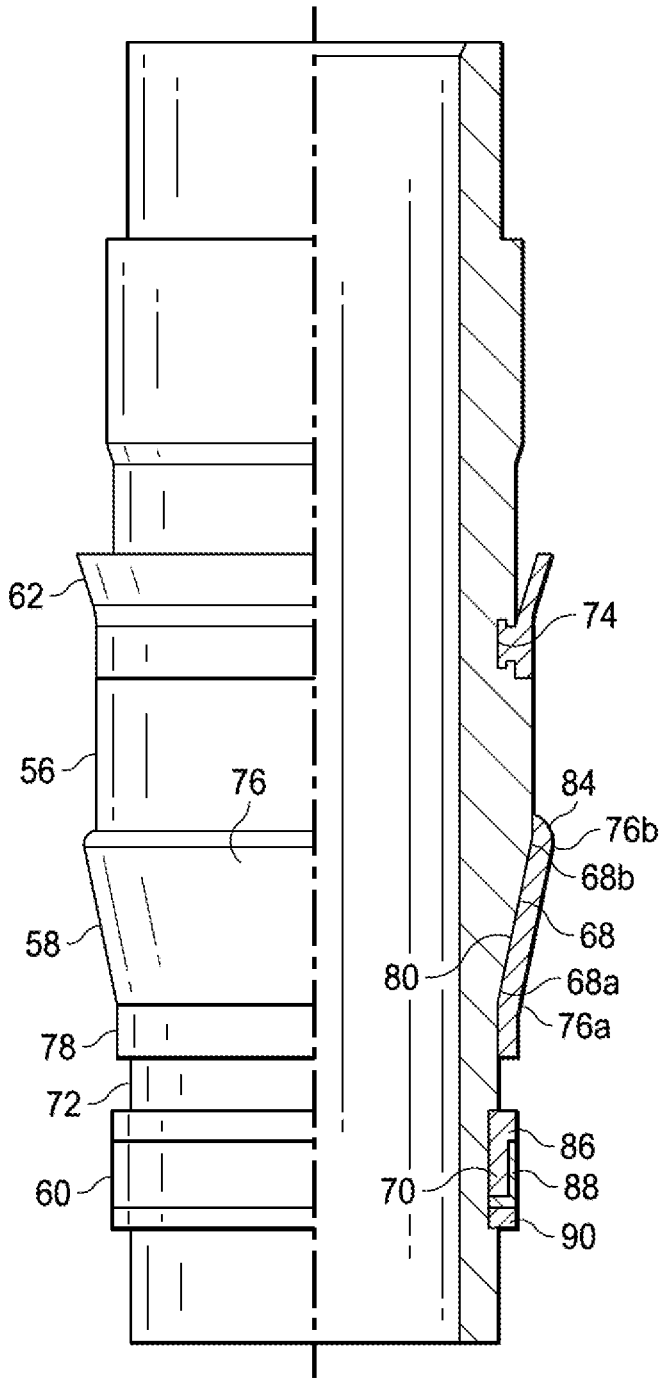
FIG. 5 depicts the cone mandrel of FIG. 3 and the collapsible expansion cone of FIG. 4, along with other components of the setting tool, in an assembled state, according to an exemplary embodiment.

Referring now to FIG. 5, the components of the setting tool 50, including the cone mandrel 56, the collapsible expansion cone 58, the cone retainer 60, and the wiper 62, are illustrated in an assembled state.

In an exemplary embodiment, as shown in FIG. 5, the interior of the contact ring 78 of the collapsible expansion cone 58 engages, and extends circumferentially about, the annular contact surface 72 of the cone mandrel 56. Moreover, the tapered internal annular surface 80 of the frusto-conical member 76 extends circumferentially about and engages, or nearly engages, the tapered annular surface 68 of the cone mandrel 56. As a result, the end portion 76*a* of the frusto-conical member 76 is located at, or near, the end portion 68*a* of the tapered annular surface 68. The relatively smaller wall thickness of the cone mandrel 56 at the end portion 68*a* of the tapered annular surface 68 is thus disposed proximate and interior to the end portion 76*a* of the frusto-conical member 76 and the end portion 78*b* of the contact ring 78. Moreover, the cone crest 84 and the end portion 76*b* of the frusto-conical member 76 are located at, or near, the end portion 68*b* of the tapered annular surface 68. The relatively larger wall thickness of the cone mandrel 56 at the end portion 68*b* of the tapered annular surface 68 is thus adapted to support the cone crest 84 and the end portion 76*b* of the frusto-conical member 76 when the collapsible expansion cone 58 engages the interior of the hanger body 48. Moreover, in several exemplary embodiments, the wall thickness of the cone mandrel 56 at the end portion 68*b* of the tapered annular surface 68 provides the geometry needed to maximize the strength of the cone mandrel 56 directly beneath the cone crest 84 of the collapsible expansion cone 58.

In an exemplary embodiment, with continuing reference to FIG. 5, the cone retainer 60 is accommodated within, and extends circumferentially about, the external annular groove 70 of the cone mandrel 56. In several exemplary embodiments, the cone retainer 60 includes a pair of split-rings 86, a split-ring retainer 88, and a retaining ring 90. However, the cone retainer 60 may omit one or more of the split-rings 86, the split-ring retainer 88, and the retaining ring 90 in favor of one or more other components adapted to engage the collapsible expansion cone 58. Moreover, in addition to, or instead of, the cone retainer 60, another type of cone retainer may be utilized. In any event, the cone retainer 60 extends beyond the periphery of the external annular groove 70 and is adapted to engage the contact ring 78 of the collapsible expansion cone 58. The collapsible expansion cone 58 is thus trapped axially between the cone retainer 60 and the tapered annular surface 68 of the cone mandrel 56. In several exemplary embodiments, the wiper 62 is accommodated within, and retained by, the external annular groove 74 of the cone mandrel 56. In this position, the wiper is adapted to prevent debris from settling on top of the collapsible expansion cone 58.

In operation, according to an exemplary embodiment as illustrated in FIGS. 6A-6D, the running tool 42 is connected at the lower end of the conveyance vehicle 36 (visible in FIG. 1). Further, the expandable liner hanger system 44 and, consequently, the liner string 46, are coupled to the running tool 42 and the conveyance vehicle 36 is used to position the running tool 42 within the casing string 40.

Figure 6A:
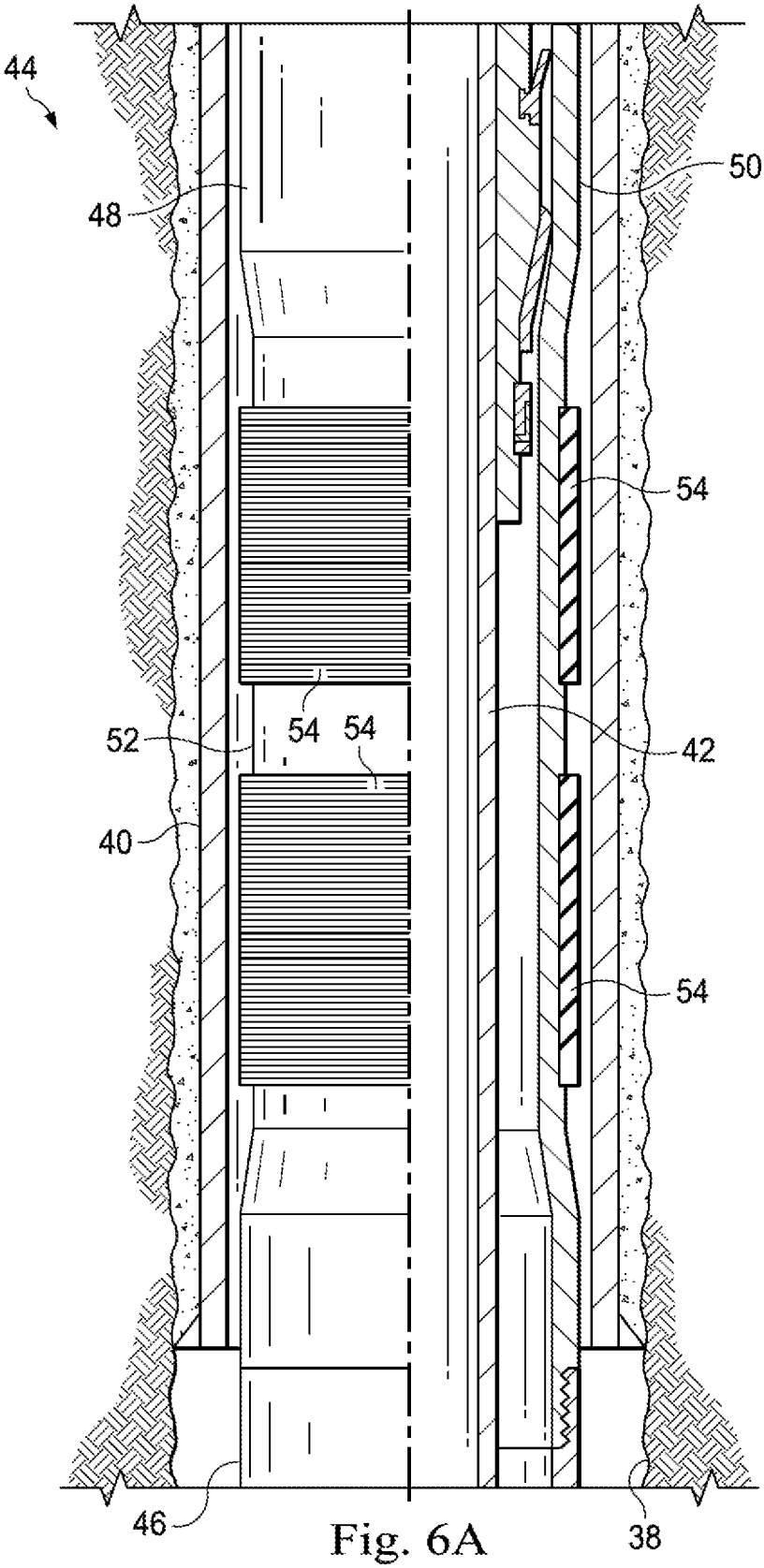
FIG. 6A is a partial-sectional view of the expandable liner hanger system of FIGS. 1-5 disposed within a wellbore and proximate the lower end of a casing string, according to an exemplary embodiment.

Referring initially to FIG. 6A, the expandable liner hanger system 44 is run into the casing string 40, via the running tool 42 and the conveyance vehicle 36, until the reduced diameter portion 52 of the hanger body 48 is located interior to the casing string 40 and at, or near, the lower end portion thereof. In this position, the liner string 46 extends from the hanger body 48 and into the "open-hole" portion of the wellbore 38 (shown in FIG. 1). In several exemplary embodiments, once the liner string 46 has been positioned in the wellbore 38 as described, a cementing operation is commenced. For example, cement (not shown) is pumped into the annulus defined between the liner string 46 and the wellbore 38 in order to support the liner string 46 within the wellbore 38. In several exemplary embodiments, during the positioning of the liner string 46 and the subsequent cementing operation, the setting tool 50 is disposed within the hanger body 48, but is not yet engaged with the interior of the reduced diameter portion 52.

Figure 6B:
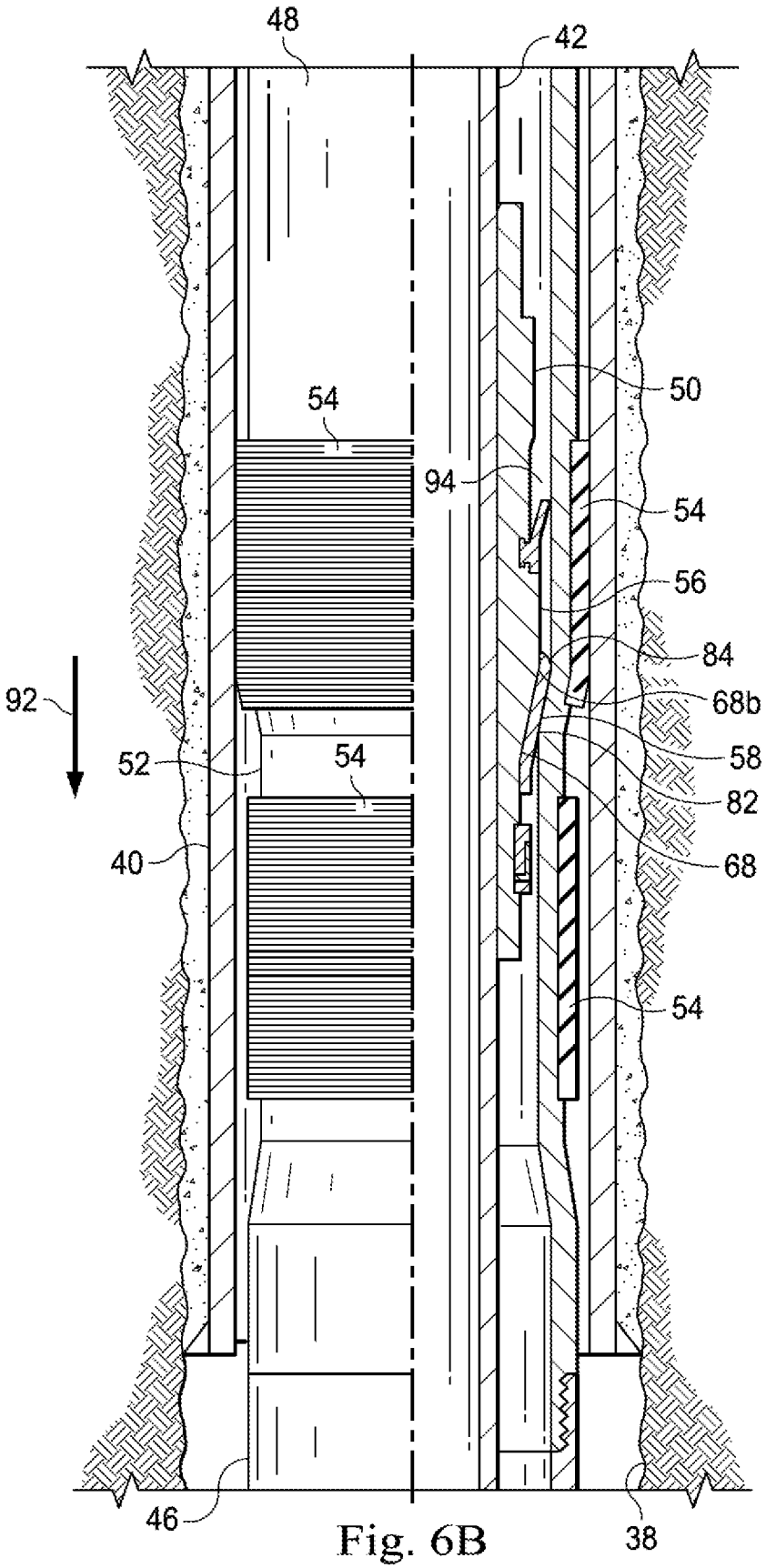
FIG. 6B is a partial-sectional view of the expandable liner hanger system of FIG. 6A in a partially-expanded state, according to an exemplary embodiment.

Referring to FIG. 6B, once the hanger body 48 is suitably positioned and the cementing operation is completed, the setting tool 50 is utilized to radially expand the hanger body 48. Specifically, when the hanger body 48 is positioned interior to the casing string 40 and proximate the lower end portion thereof, the cone mandrel 56 is displaced in an axial direction 92, thereby urging the collapsible expansion cone 58 to engage the interior of the reduced diameter portion 52 of the hanger body 48. In several exemplary embodiments, the cone mandrel 56 and the collapsible expansion cone 58 are displaced by increasing the hydraulic fluid pressure within an annular space 94 defined between the running tool 42 and the hanger body 48. The engagement of the collapsible expansion cone 58 with the interior of the reduced diameter portion 52 of the hanger body 48 forms a seal so that the setting tool 50 acts as a hydraulic piston within the hanger body 48. Additionally, a seal is incorporated on the interior of the cone mandrel 56 to seal against the running tool 42 so that the increased hydraulic fluid pressure within the annular space 94 acts upon the cone mandrel 56 and the collapsible expansion cone 58. As a result, the hydraulic fluid pressure within the annular space 94 urges the setting tool 50 in the direction 92. Once a sufficient hydraulic fluid pressure has been reached, the cone mandrel 56 and the collapsible expansion cone 58 are displaced in the axial direction 92, and relative to the hanger body 48, so that the collapsible expansion cone 58 slidably engages, and radially expands, the interior of the reduced diameter portion 52 of the hanger body 48. In several exemplary embodiments, in addition to, or instead of, the collapsible expansion cone 58 being displaced by increasing the hydraulic fluid pressure within the annular space 94, the collapsible expansion cone 58 is displaced by imparting axial force to the cone mandrel 56 with the running tool 42.

As the collapsible expansion cone 58 slidably engages the hanger body 48, the tapered external annular surface 82 and the cone crest 84 impart radial force to the interior of the reduced diameter portion 52, causing the exterior of hanger body 48 to expand radially. In several exemplary embodiments, the uniform cross-section of the collapsible expansion cone 58 is fully supported radially by the cone mandrel 56 during the expansion of the hanger body 48. Moreover, the relatively larger wall thickness of the cone mandrel 56 at the end portion 68*b* of the tapered annular surface 68 supports the cone crest 84 during the radial expansion of the hanger body 48. The radial expansion of the hanger body 48 causes the exterior of the reduced diameter portion 52 to be urged into engagement with the interior of the casing string 40. Consequently, the contact elements 54 are expanded into engagement with the interior of the casing string 40. The contact elements 54 form a frictional interface with the interior of the casing string 40 when the reduced diameter portion 52 is expanded, thus connecting the hanger body 48 to the casing string 40. In several exemplary embodiments, the contact elements 54 are, include, or are part of a cylindrical seal made of a rubber material and adapted to form a frictional interface with the interior of the casing string 40 when the reduced diameter portion 52 is expanded. In several exemplary embodiments, the contact elements 54 are, include, or are part of a plurality of casing slips adapted to engage, or "bite" into, the interior of the casing string 40 when the reduced diameter portion 52 is expanded. In several exemplary embodiments, the contact elements 54 are integrally formed with the hanger body 48 and are designed to sealingly engage the interior of the casing string 40 when the hanger body 48 is expanded.

Figure 6C:
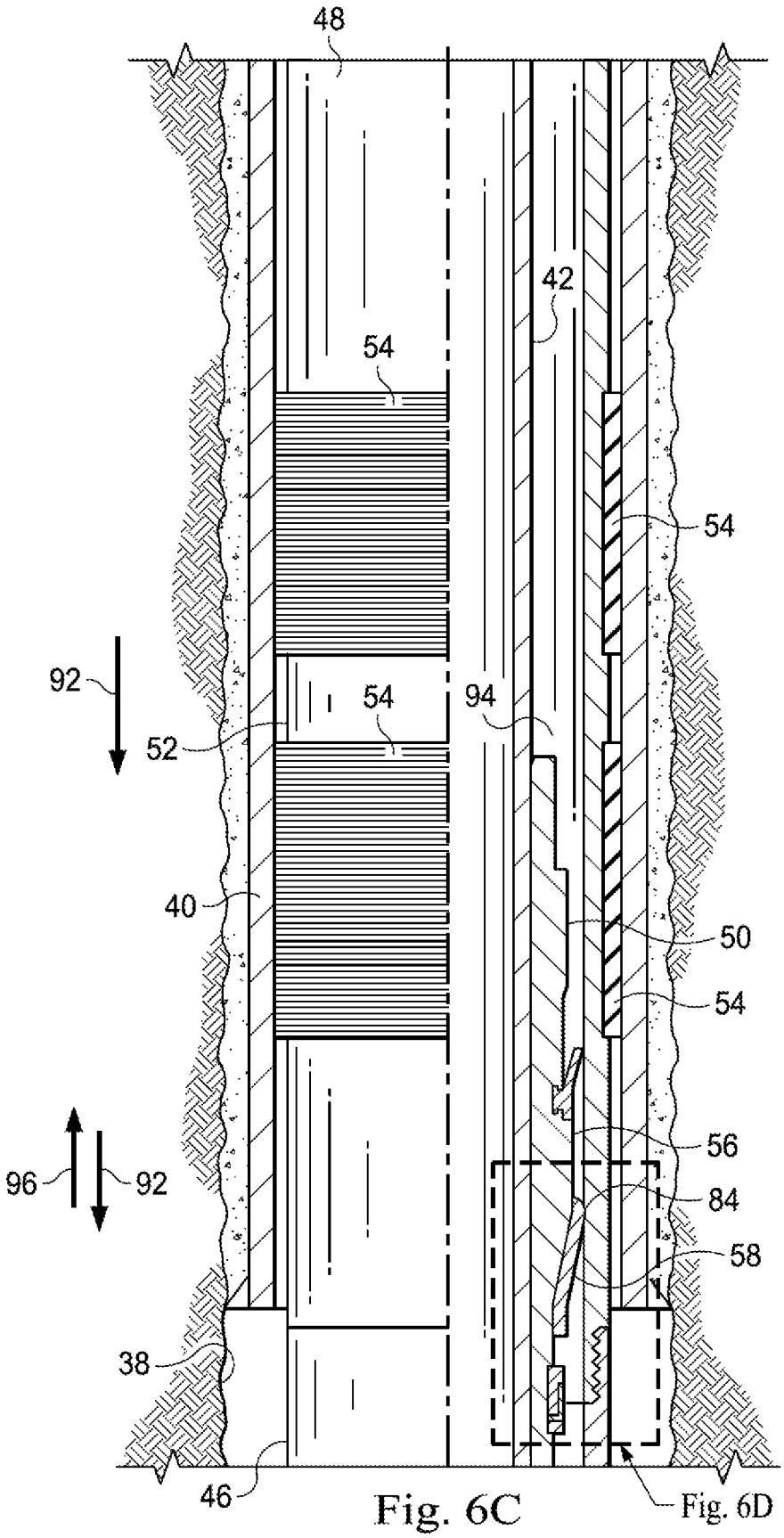
FIG. 6C is a partial-sectional view of the expandable liner hanger system of FIGS. 6A and 6B in a fully-expanded state, according to an exemplary embodiment.

Referring additionally to FIG. 6C, hydraulic pressure is continuously applied within the annular space 94 until the entire length of the reduced diameter portion 52 is expanded to engage the casing string 40. At this point, expansion of the hanger body 48 is complete and the liner string 46 is set within the wellbore 38. Once the expansion of the hanger body 48 is complete, the cone mandrel 56 and the collapsible expansion cone 58 must be retrieved from the wellbore 38. However, due to the material properties of the hanger body 48 and the considerable force required to expand the hanger body 48, a small amount of strain is recovered by the interior of the reduced diameter portion 52 after it has been expanded by the collapsible expansion cone 58. The strain recovered by the interior of the reduced diameter portion 52 causes the expanded hanger body 48 to obstruct displacement of the collapsible expansion cone 58 in an axial direction 96, which is opposite the axial direction 92.

Figure 6D:
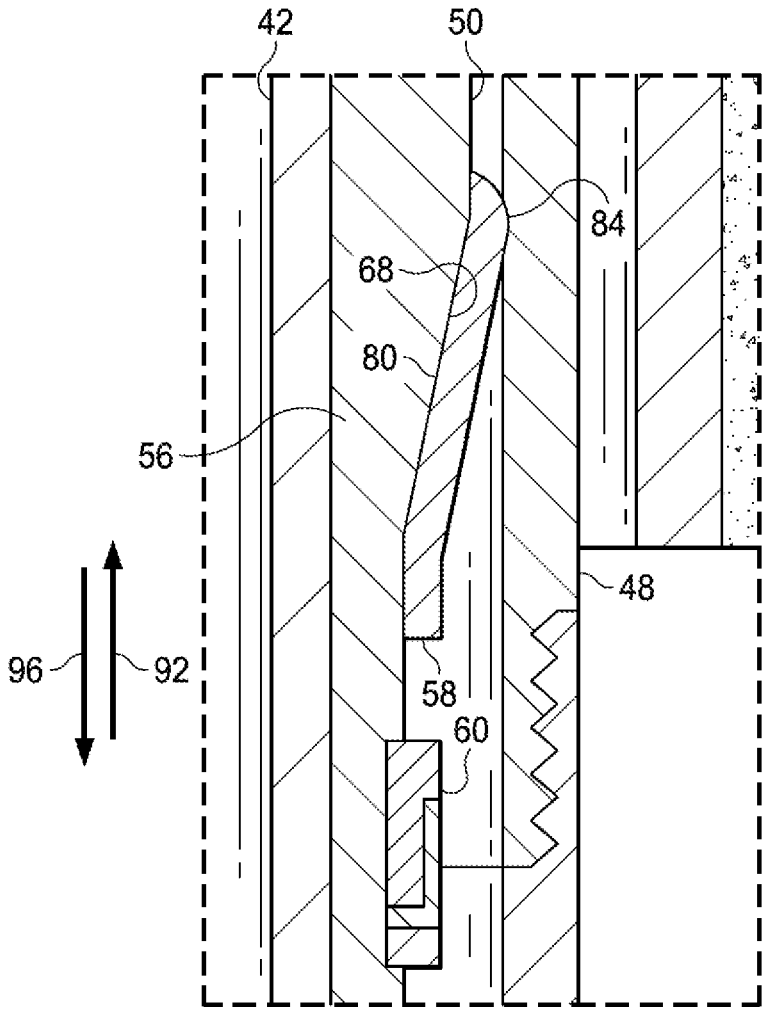
FIG. 6D(i) is an enlarged view of the expandable liner hanger system of FIG. 6C, with the hanger body expanded and the setting tool in a first configuration, according to an exemplary embodiment.

According to an exemplary embodiment, as illustrated in FIGS. 6D(i)-(iii), the interior of the expanded hanger body 48 acts as a restriction that prevents, or at least obstructs, respective portions of the collapsible expansion cone 58, including at least the cone crest 84, from being displaced in the axial direction 96 and relative to the hanger body 48.

As shown in FIG. 6D(i), certain components of the setting tool 50, including at least the collapsible expansion cone 58 and the cone retainer 60, facilitate extrication of the setting tool 50 from the hanger body 48. Accordingly, the setting tool 50 is extricated from the hanger body 48 by first displacing the cone mandrel 56 in the axial direction 96 and relative to both of the collapsible expansion cone 58 and the hanger body 48. As the running tool 42 and the cone mandrel 56 are retracted from the expanded hanger body 48 in the axial direction 96, the tapered internal annular surface 80 of the collapsible expansion cone 58 and the tapered annular surface 68 of the cone mandrel 56 begin to disengage.

As shown in FIG. 6D(ii), the cone mandrel 56 continues to be displaced relative to the collapsible expansion cone 58 until the cone retainer 60 engages the end face 85 of the contact ring 78. At the same time, the gap between the tapered internal annular surface 80 and the tapered annular surface 68 continues to grow until, eventually, the collapsible expansion cone 58 is un-propped from the cone mandrel 56. Moreover, during the displacement of the cone mandrel 56 in the axial direction 96 and relative to the collapsible expansion cone 58, the annular contact surface 72 of the cone mandrel 56 slidably engages the interior of the contact ring 78.

As shown in FIG. 6D(iii), subsequent displacement of the cone mandrel 56 in the axial direction 96 urges the collapsible expansion cone 58 to be displaced relative to the hanger body 48. The thickness and material properties of the collapsible expansion cone 58 permit the frusto-conical member 76 thereof to bell radially inward at the cone crest 84 when the collapsible expansion cone 58 is un-propped from the cone mandrel 56. Thus, as the collapsible expansion cone 58 is urged in the axial direction 96 and relative to the hanger body 48, the frusto-conical member 76 bells radially inward at the cone crest 84. In this manner, the inward belling of the frusto-conical member 76 permits the extrication of the setting tool 50 through the tight-fitting interior of the expanded hanger body 48.

In several exemplary embodiments, by eliminating the need for irregular surface features associated with expansion cones that incorporate, for example, collet features, the collapsible expansion cone 58 prevents, or at least reduces, damage to any friction reducing coatings applied to the hanger body 48 and/or the collapsible expansion cone 58. In several exemplary embodiments, the collapsible expansion cone 58 provides additional structural resistance to hoop or radial stress patterns imparted thereto during the expansion of the hanger body 48 as compared to conventional expansion cones incorporating, for example, a collet feature. In several exemplary embodiments, the collapsible expansion cone 58 provides a sealing interface with the interior of the hanger body 48 that is coincident with the cone crest 84, thus increasing the axial force imparted to the setting tool 50 by the hydraulic fluid pressure within the annular space 94 as compared to an expansion cone having, for example, a collet feature that requires a "lead cone" for effective expansion.

In several exemplary embodiments, the collapsible expansion cone 58 has an uninterrupted and/or uniform circumferential wall thickness that operates to reduce the stress transferred to the cone mandrel 56 during expansion of the hanger body 48. In several exemplary embodiments, the collapsible expansion cone 58 has a uniform cross-section that optimizes the material properties of the collapsible expansion cone 58 after the case hardening and/or the heat treatment thereof.

In several exemplary embodiments, the collapsible expansion cone 58 defines a continuous, slit-less, circumferentially-extending body. In several exemplary embodiments, every cross-section of the collapsible expansion cone 58 that is taken along a plane in which the longitudinal axis of the collapsible expansion cone 58 extends is substantially identical.

In several exemplary embodiments, the collapsible expansion cone 58 provides a simple, cost-effective, and easy-to-manufacture expansion cone that prevents, or at least reduces, damage to the expanded hanger body 48 during extrication of the setting tool 50. In several exemplary embodiments, the collapsible expansion cone 58 is a disposable, one-time use expansion cone that mitigates the risk associated with the expansion of nickel alloy and/or high-chromium alloy hanger bodies.

The present disclosure introduces an expandable liner hanger system, including a setting tool, including a cone mandrel defining a tapered external annular surface and adapted to be displaced in first and second axial directions; an expansion cone extending about the cone mandrel and defining a tapered internal annular surface adapted to be engaged by the tapered external annular surface when the cone mandrel is displaced in the first axial direction; and a cone retainer extending from the cone mandrel and adapted to engage the expansion cone when the cone mandrel is displaced in the second axial direction and relative to the expansion cone; and a hanger body adapted to be radially expanded by the expansion cone when the cone mandrel and the expansion cone are displaced in the first axial direction and relative to the hanger body; wherein, when the cone retainer engages the expansion cone, the tapered internal annular surface is disengaged from the tapered external annular surface, thus enabling the expansion cone to bell radially inward. In an exemplary embodiment, when the hanger body is radially expanded by the setting tool, the hanger body is adapted to fixedly engage a casing string disposed within a wellbore. In an exemplary embodiment, the expandable liner hanger further includes a liner string connected to the hanger body and adapted to extend into the wellbore beyond the casing string when the hanger body fixedly engages the casing string. In an exemplary embodiment, the expansion cone includes a contact ring adapted to be engaged by the cone retainer when the cone mandrel is displaced in the second axial direction and relative to the expansion cone; and a frusto-conical member connected to the contact ring and defining a cone crest that is adapted to slidably engage, and radially expand, the hanger body when the expansion cone is displaced in the first axial direction and relative to the hanger body. In an exemplary embodiment, the tapered external annular surface of the cone mandrel defines first and second end portions; the cone mandrel defines a first wall thickness at the first end portion and a second wall thickness at the second end portion; and the first wall thickness of the cone mandrel is greater than the second wall thickness of the cone mandrel. In an exemplary embodiment, when the hanger body is radially expanded by the expansion cone, the first wall thickness of the cone mandrel is adapted to support a portion of the expansion cone, including at least the cone crest. In an exemplary embodiment, the cone mandrel further defines an external annular groove and an annular contact surface extending between the external annular groove and the tapered external annular surface; and the external annular groove accommodates the cone retainer, thus trapping the expansion cone axially between the cone retainer and the tapered external annular surface. In an exemplary embodiment, when the cone mandrel is displaced in the second axial direction and relative to the expansion cone, the annular contact surface slidably engages the contact ring and the tapered internal annular surface is disengaged from the tapered external annular surface. In an exemplary embodiment, the expansion cone is adapted to be displaced in the second axial direction and relative to the hanger body after the hanger body is radially expanded and the tapered internal annular surface is disengaged from the tapered external annular surface; and, when the expansion cone is displaced in the second axial direction and relative to the hanger body, the frusto-conical member is adapted to bell radially inward at the cone crest to permit extrication of the expansion cone from the hanger body. In an exemplary embodiment, when the hanger body is radially expanded by the expansion cone, the cone crest is adapted to be sealingly engaged with the hanger body; and the sealing engagement of the cone crest with the hanger body causes the displacement of the expansion cone in the first axial direction, and relative to the hanger body, to be effectuated by a fluid pressure within the hanger body.

The present disclosure also introduces a method of installing an expandable liner hanger system within a casing string, the method including positioning the expandable liner hanger system within the casing string, the expandable liner hanger system including a hanger body and a setting tool disposed within the hanger body, the setting tool including a cone mandrel defining a tapered external annular surface and an expansion cone defining a tapered internal annular surface; engaging the tapered external annular surface of the cone mandrel with the tapered internal annular surface of the expansion cone; radially expanding the hanger body to engage the casing string by displacing the cone mandrel and the expansion cone in a first axial direction and relative to the hanger body; displacing the cone mandrel in a second axial direction and relative to the expansion cone to disengage the tapered internal annular surface from the tapered external annular surface, thus permitting the expansion cone to bell radially inward from the hanger body; and extricating the expansion cone from the expanded hanger body. In an exemplary embodiment, the expandable liner hanger system further includes a liner string connected to the hanger body; and, when the hanger body is expanded by the expansion cone to engage the casing string, the liner string extends into the wellbore beyond the casing string. In an exemplary embodiment, the setting tool further includes a cone retainer extending from the cone mandrel; and extricating the expansion cone from the expanded hanger body includes engaging the expansion cone with the cone retainer and displacing the expansion cone in the second axial direction and relative to the hanger body. In an exemplary embodiment, the cone mandrel further defines an external annular groove and an annular contact surface extending between the external annular groove and the tapered external annular surface; and the external annular groove accommodates the cone retainer, thus trapping the expansion cone axially between the cone retainer and the tapered external annular surface. In an exemplary embodiment, when the cone mandrel is displaced in the second axial direction and relative to the expansion cone to disengage the tapered internal annular surface from the tapered external annular surface, the annular contact surface of the cone mandrel slidably engages the contact ring. In an exemplary embodiment, the expansion cone includes a contact ring and a frusto-conical member connected to the contact ring, the frusto-conical member defining a cone crest; and radially expanding the hanger body to engage the casing string includes slidably engaging the frusto-conical member, including at least the cone crest, with a reduced diameter portion of the hanger body, thus imparting radially outward force to the hanger body. In an exemplary embodiment, radially expanding the hanger body to engage the casing string further includes sealingly engaging the cone crest with the hanger body and effecting the displacement of the expansion cone in the first axial direction using a fluid pressure within the hanger body. In an exemplary embodiment, the tapered external annular surface of the cone mandrel defines first and second end portions; the cone mandrel defines a first wall thickness at the first end portion and a second wall thickness at the second end portion; and the first wall thickness of the cone mandrel is greater than the second wall thickness of the cone mandrel. In an exemplary embodiment, when the hanger body is radially expanded by the expansion cone, the first wall thickness of the cone mandrel is adapted to support a portion of the frusto-conical member, including at least the cone crest. In an exemplary embodiment, extricating the expansion cone includes displacing the expansion cone in the second axial direction and relative to the hanger body after the hanger body is radially expanded and the tapered internal annular surface is disengaged from the tapered external annular surface; and, when the expansion cone is displaced in the second axial direction and relative to the hanger body, the frusto-conical member is adapted to bell radially inward at the cone crest to permit extrication of the expansion cone from the hanger body.

It is understood that variations may be made in the foregoing without departing from the scope of the present disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes, and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. An expandable liner hanger system, comprising:

a setting tool, comprising:

a cone mandrel defining a tapered external annular surface and adapted to be displaced in first and second axial directions;

an expansion cone extending about the cone mandrel the expansion cone defining a cone crest and a tapered internal annular surface, which tapered internal annular surface is adapted to be engaged by the tapered external annular surface when the cone mandrel is displaced in the first axial direction; and a cone retainer connected to the cone mandrel and adapted to engage the expansion cone when the cone mandrel is displaced in the second axial direction and relative to the expansion cone;

and a hanger body adapted to be radially expanded by the expansion cone when the cone mandrel and the expansion cone are displaced in the first axial direction and relative to the hanger body;

wherein the expansion cone defines a sealing interface with the hanger body;

wherein, when the hanger body is radially expanded by the expansion cone, the cone crest is adapted to sealingly engage the hanger body to thereby define the sealing interface; and wherein, when the cone retainer engages the expansion cone, the tapered internal annular surface is disengaged from the tapered external annular surface so that the expansion cone is permitted to bell radially inward.

2. The expandable liner hanger system of claim 1, wherein, when the hanger body is radially expanded by the setting tool, the hanger body is adapted to fixedly engage a casing string disposed within a wellbore.

3. The expandable liner hanger system of claim 2, further comprising a liner string connected to the hanger body and adapted to extend into the wellbore beyond the casing string when the hanger body fixedly engages the casing string.

4. The expandable liner hanger system of claim 1, wherein the expansion cone comprises:

a contact ring adapted to be engaged by the cone retainer when the cone mandrel is displaced in the second axial direction and relative to the expansion cone; and a frusto-conical member connected to the contact ring and defining the cone crest that is adapted to slidably engage, and radially expand, the hanger body when the expansion cone is displaced in the first axial direction and relative to the hanger body.

5. The expandable liner hanger system of claim 4, wherein the tapered external annular surface of the cone mandrel defines first and second end portions;

wherein the cone mandrel defines a first wall thickness at the first end portion and a second wall thickness at the second end portion; and wherein the first wall thickness of the cone mandrel is greater than the second wall thickness of the cone mandrel.

6. The expandable liner hanger system of claim 5, wherein, when the hanger body is radially expanded by the expansion cone, the first wall thickness of the cone mandrel is adapted to support a portion of the expansion cone, including at least the cone crest.

7. The expandable liner hanger system of claim 4, wherein the cone mandrel further defines an external annular groove and an annular contact surface extending between the external annular groove and the tapered external annular surface; and wherein the external annular groove accommodates the cone retainer, thus trapping the expansion cone axially between the cone retainer and the tapered external annular surface.

8. The expandable liner hanger system of claim 7, wherein, when the cone mandrel is displaced in the second axial direction and relative to the expansion cone, the annular contact surface slidably engages the contact ring and the tapered internal annular surface is disengaged from the tapered external annular surface.

9. The expandable liner hanger system of claim 4, wherein the expansion cone is adapted to be displaced in the second axial direction and relative to the hanger body after the hanger body is radially expanded and the tapered internal annular surface is disengaged from the tapered external annular surface; and wherein, when the expansion cone is displaced in the second axial direction and relative to the hanger body, the frusto-conical member is adapted to bell radially inward at the cone crest to permit extrication of the expansion cone from the hanger body.

10. The expandable liner hanger system of claim 4, wherein the sealing engagement of the cone crest with the hanger body causes the displacement of the expansion cone in the first axial direction, and relative to the hanger body, to be effectuated by a fluid pressure within the hanger body.

11. A method of installing an expandable liner hanger system within a casing string, the method comprising:

positioning the expandable liner hanger system within the casing string, the expandable liner hanger system comprising a hanger body and a setting tool disposed within the hanger body, the setting tool comprising: a cone mandrel defining a tapered external annular surface; and an expansion cone defining a tapered internal annular surface and a cone crest;

engaging the tapered external annular surface of the cone mandrel with the tapered internal annular surface of the expansion cone;

radially expanding the hanger body to engage the casing string by displacing the cone mandrel and the expansion cone in a first axial direction and relative to the hanger body and creating a sealing interface between the expansion cone and the hanger body, wherein creating the sealing interface between the expansion cone and the hanger body comprises sealingly engaging the cone crest with the hanger body;

displacing the cone mandrel in a second axial direction and relative to the expansion cone to disengage the tapered internal annular surface from the tapered external annular surface, thus permitting the expansion cone to bell radially inward from the hanger body; and extricating the expansion cone from the expanded hanger body.

12. The method of claim 11, wherein the expandable liner hanger system further comprises a liner string connected to the hanger body; and wherein, when the hanger body is expanded by the expansion cone to engage the casing string, the liner string extends into the wellbore beyond the casing string.

13. The method of claim 11, wherein the setting tool further comprises a cone retainer extending from the cone mandrel; and wherein extricating the expansion cone from the expanded hanger body comprises engaging the expansion cone with the cone retainer and displacing the expansion cone in the second axial direction and relative to the hanger body.

14. The method of claim 13, wherein the cone mandrel further defines an external annular groove and an annular contact surface extending between the external annular groove and the tapered external annular surface; and wherein the external annular groove accommodates the cone retainer, thus trapping the expansion cone axially between the cone retainer and the tapered external annular surface.

15. The method of claim 14, wherein, when the cone mandrel is displaced in the second axial direction and relative to the expansion cone to disengage the tapered internal annular surface from the tapered external annular surface, the annular contact surface of the cone mandrel slidably engages the contact ring.

16. The method of claim 11, wherein the expansion cone comprises a contact ring and a frusto-conical member connected to the contact ring, the frusto-conical member defining the cone crest; and wherein radially expanding the hanger body to engage the casing string comprises slidably engaging the frusto-conical member, including at least the cone crest, with a reduced diameter portion of the hanger body, thus imparting radially outward force to the hanger body.

17. The method of claim 16, wherein radially expanding the hanger body to engage the casing string further comprises effecting the displacement of the expansion cone in the first axial direction using a fluid pressure within the hanger body.

18. The method of claim 16, wherein the tapered external annular surface of the cone mandrel defines first and second end portions;

wherein the cone mandrel defines a first wall thickness at the first end portion and a second wall thickness at the second end portion; and wherein the first wall thickness of the cone mandrel is greater than the second wall thickness of the cone mandrel.

19. The method of claim 18, wherein, when the hanger body is radially expanded by the expansion cone, the first wall thickness of the cone mandrel is adapted to support a portion of the frusto-conical member, including at least the cone crest.

20. The method of claim 16, wherein extricating the expansion cone comprises displacing the expansion cone in the second axial direction and relative to the hanger body after the hanger body is radially expanded and the tapered internal annular surface is disengaged from the tapered external annular surface; and wherein, when the expansion cone is displaced in the second axial direction and relative to the hanger body, the frusto-conical member is adapted to bell radially inward at the cone crest to permit extrication of the expansion cone from the hanger body.

* * * * *